US006474793B1

(12) United States Patent
Van Kempen et al.

(10) Patent No.: US 6,474,793 B1
(45) Date of Patent: Nov. 5, 2002

(54) METHOD OF FORMING PICTURE ELEMENTS ON A SUBSTRATE

(75) Inventors: Robertus J. Th. Van Kempen, Volkel (NL); Paulus J. Th. Eggenkamp, Rosmalen (NL); Martinus G. J. Manders, Boxmeer (NL)

(73) Assignee: Stork Digital Imaging, B.V., Boxmeer (NL)

( * ) Notice: Subject to any disclaimer, the term of this patent is extended or adjusted under 35 U.S.C. 154(b) by 0 days.

(21) Appl. No.: 09/677,330

(22) Filed: Sep. 28, 2000

Related U.S. Application Data

(63) Continuation of application No. PCT/NL99/00186, filed on Mar. 30, 1996.

(30) Foreign Application Priority Data

Mar. 31, 1998 (NL) ..... 1008762

(51) Int. Cl.[7] ..... B41J 2/075

(52) U.S. Cl. ..... 347/74

(58) Field of Search ..... 347/74, 15

(56) References Cited

U.S. PATENT DOCUMENTS

| | | | | |
|---|---|---|---|---|
| 4,065,773 A | * 12/1977 | Berry | ..... | 347/15 |
| 4,472,722 A | 9/1984 | Ebi | | |
| 4,525,721 A | 6/1985 | Crean | | |
| 4,920,355 A | 4/1990 | Katerberg | | |

FOREIGN PATENT DOCUMENTS

| | | |
|---|---|---|
| EP | 0036788 | 3/1981 |
| EP | 0 476 860 A2 | 8/1991 |
| EP | 0 596 723 A1 | 11/1993 |
| JP | 03 05529 | 3/1989 |
| WO | WO 91/07283 | 11/1990 |

* cited by examiner

*Primary Examiner*—Anh T. N. Vo
(74) *Attorney, Agent, or Firm*—Todd Deveau; Ryan A. Schneider; Troutman Sanders LLP

(57) ABSTRACT

An ink-jet printer several pixels lying, for example, on different image lines are formed essentially simultaneously by sending the necessary ink droplets to the appropriate pixels and by intercepting the ink droplets not required. In order to prevent ink droplets which are sent to different pixels from influencing each other, the invention provides for the ink droplets which are sent to a pixel to be distributed essentially homogeneously over the series of ink droplets.

8 Claims, 4 Drawing Sheets

| Droplet No. | Interlace sequence | Charging voltage |
|---|---|---|
| 1 | 1 | V1 |
| 2 | 3 | V3 |
| 3 | 5 | V5 |
| 4 | 2 | V2 |
| 5 | 4 | V4 |
| 6 | 1 | 0 |
| 7 | 3 | V3 |
| 8 | 5 | V5 |
| 9 | 2 | V2 |
| 10 | 4 | V4 |
| 11 | 1 | 0 |
| 12 | 3 | V3 |
| 13 | 5 | V5 |
| 14 | 2 | V2 |
| 15 | 4 | V4 |
| 16 | 1 | 0 |
| 17 | 3 | 0 |
| 18 | 5 | V5 |
| 19 | 2 | V2 |
| 20 | 4 | V4 |
| 21 | 1 | 0 |
| 22 | 3 | 0 |
| 23 | 5 | V5 |
| 24 | 2 | V2 |
| 25 | 4 | V4 |
| 26 | 1 | 0 |
| 27 | 3 | 0 |
| 28 | 5 | V5 |
| 29 | 2 | V2 |
| 30 | 4 | V4 |
| 31 | 1 | 0 |
| 32 | 3 | 0 |
| 33 | 5 | 0 |
| 34 | 2 | V2 |
| 35 | 4 | 0 |
| 36 | 1 | 0 |
| 37 | 3 | 0 |
| 38 | 5 | 0 |
| 39 | 2 | 0 |
| 40 | 4 | 0 |

| Droplet No. | Interlace sequence | Charging voltage |
|---|---|---|
| 41 | 1 | 0 |
| 42 | 3 | 0 |
| 43 | 5 | 0 |
| 44 | 2 | 0 |
| 45 | 4 | 0 |
| 46 | 1 | 0 |
| 47 | 3 | 0 |
| 48 | 5 | 0 |
| 49 | 2 | 0 |
| 50 | 4 | 0 |
| 51 | 1 | 0 |
| 52 | 3 | 0 |
| 53 | 5 | 0 |
| 54 | 2 | 0 |
| 55 | 4 | 0 |
| 56 | 1 | 0 |
| 57 | 3 | 0 |
| 58 | 5 | 0 |
| 59 | 2 | 0 |
| 60 | 4 | 0 |
| 61 | 1 | 0 |
| 62 | 3 | 0 |
| 63 | 5 | 0 |
| 64 | 2 | 0 |
| 65 | 4 | 0 |
| 66 | 1 | 0 |
| 67 | 3 | 0 |
| 68 | 5 | 0 |
| 69 | 2 | 0 |
| 70 | 4 | 0 |
| 71 | 1 | 0 |
| 72 | 3 | 0 |
| 73 | 5 | 0 |
| 74 | 2 | 0 |
| 75 | 4 | 0 |

FIG. 3.

| Droplet No. | Interlace sequence | Charging voltage |
|---|---|---|
| 1 | 1 | 0 |
| 2 | 3 | 0 |
| 3 | 5 | 0 |
| 4 | 2 | 0 |
| 5 | 4 | V4 |
| 6 | 1 | 0 |
| 7 | 3 | 0 |
| 8 | 5 | 0 |
| 9 | 2 | V2 |
| 10 | 4 | 0 |
| 11 | 1 | 0 |
| 12 | 3 | 0 |
| 13 | 5 | V5 |
| 14 | 2 | 0 |
| 15 | 4 | 0 |
| 16 | 1 | 0 |
| 17 | 3 | V3 |
| 18 | 5 | 0 |
| 19 | 2 | 0 |
| 20 | 4 | V4 |
| 21 | 1 | 0 |
| 22 | 3 | 0 |
| 23 | 5 | 0 |
| 24 | 2 | V2 |
| 25 | 4 | 0 |
| 26 | 1 | 0 |
| 27 | 3 | 0 |
| 28 | 5 | V5 |
| 29 | 2 | 0 |
| 30 | 4 | 0 |
| 31 | 1 | 0 |
| 32 | 3 | V3 |
| 33 | 5 | 0 |
| 34 | 2 | V2 |
| 35 | 4 | 0 |
| 36 | 1 | 0 |
| 37 | 3 | 0 |
| 38 | 5 | 0 |
| 39 | 2 | V2 |
| 40 | 4 | 0 |

| Droplet No. | Interlace sequence | Charging voltage |
|---|---|---|
| 41 | 1 | 0 |
| 42 | 3 | 0 |
| 43 | 5 | V5 |
| 44 | 2 | 0 |
| 45 | 4 | V4 |
| 46 | 1 | 0 |
| 47 | 3 | 0 |
| 48 | 5 | 0 |
| 49 | 2 | V2 |
| 50 | 4 | 0 |
| 51 | 1 | V1 |
| 52 | 3 | 0 |
| 53 | 5 | 0 |
| 54 | 2 | 0 |
| 55 | 4 | V4 |
| 56 | 1 | 0 |
| 57 | 3 | 0 |
| 58 | 5 | V5 |
| 59 | 2 | 0 |
| 60 | 4 | V4 |
| 61 | 1 | 0 |
| 62 | 3 | V3 |
| 63 | 5 | 0 |
| 64 | 2 | V2 |
| 65 | 4 | 0 |
| 66 | 1 | 0 |
| 67 | 3 | 0 |
| 68 | 5 | V5 |
| 69 | 2 | 0 |
| 70 | 4 | V4 |
| 71 | 1 | 0 |
| 72 | 3 | 0 |
| 73 | 5 | 0 |
| 74 | 2 | V2 |
| 75 | 4 | 0 |

FIG. 4.

| WV 1 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | | | | | | | | | | | x | | | | |
| 3 | | | | | | | x | | | | | | | | |
| 5 | | | x | | | | | | | | | | | | |
| 2 | | | | | | | | | | | | | | | x |
| 4 | | | | | | | | | | | | | | x | |

| WV 2 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | | | | | | | | x | | | x | | | | |
| 3 | | | | x | | | x | | | | | | | | |
| 5 | | | x | | | | | | x | | | | | | |
| 2 | | | | | x | | | | | | | | | | x |
| 4 | x | | | | | | | | | | | | | x | |

| WV 3 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | | | | | | | | x | | | x | | | x | |
| 3 | | | | x | | | x | | | | | | x | | |
| 5 | | | x | | | x | | | x | | | | | | |
| 2 | | x | | | x | | | | | | | | | | x |
| 4 | x | | | | | | | | | | x | | | x | |

| WV 4 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | x | | | | | | | x | | | x | | | x | |
| 3 | | | | x | | | x | | | x | | | x | | |
| 5 | | | x | | | x | | | x | | | x | | | |
| 2 | | x | | | x | | | x | | | | | | | x |
| 4 | x | | | x | | | | | | | x | | | x | |

| WV 5 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | x | | | | | x | | x | | | x | | | x | |
| 3 | | x | | x | | | x | | | x | | | x | | |
| 5 | | | x | | | x | | | x | | | x | | x | |
| 2 | | x | | | x | | x | x | | | | | | | x |
| 4 | x | | | x | | | | | x | | x | | | x | |

⋮

| WV12 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | x | x | x | | x | x | | x | x | x | x | x | | x | x |
| 3 | x | x | | x | x | | x | x | | x | x | x | x | x | x |
| 5 | x | | x | x | | x | x | x | x | x | x | x | x | x | |
| 2 | | x | x | x | x | x | x | x | x | x | | x | x | | x |
| 4 | x | x | x | x | x | x | x | x | x | | x | x | | x | x |

| WV13 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | x | x | x | x | x | x | | x | x | x | x | x | | x | x |
| 3 | x | x | | x | x | x | x | x | | x | x | x | x | x | x |
| 5 | x | x | x | x | | x | x | x | x | x | x | x | x | x | |
| 2 | | x | x | x | x | x | x | x | x | x | | x | x | x | x |
| 4 | x | x | x | x | x | x | | x | x | x | x | x | | x | x |

⋮

FIG. 5.

METHOD OF FORMING PICTURE ELEMENTS ON A SUBSTRATE

CROSS-REFERENCE TO RELATED APPLICATIONS

This is a continuation application of PCT/NL99/00186 filed Mar. 30, 1999.

FIELD OF THE INVENTION

The invention relates to a method for essentially simultaneously forming, from a single series of ink droplets and using an ink-jet printer, several pixels on a substrate, wherein groups of ink droplets from the series are allocated to the pixels, and wherein, depending on the number of ink droplets required for a pixel, the ink droplets are subsequently either sent to the pixel concerned or intercepted. Such a method is known in practice.

BACKGROUND OF THE INVENTION

Modern ink-jet printers are often designed for printing several image lines essentially simultaneously during a printing movement, in other words, during a movement of the print head relative to the substrate. For this purpose, several pixels situated on different image lines are in each case printed essentially simultaneously by distributing a series of ink droplets over said pixels. In this case the number of ink droplets from which each pixel is composed can vary, depending on the image to be printed. However, within the series of ink droplets an (in principle, fixed) assignment is made beforehand, in which a group of ink droplets from the series is allocated in each case to the different lines, and thus to the different pixels. For each set of pixels to be formed simultaneously, at least one series of ink droplets in which a number of ink droplets is always reserved for a specific pixel is therefore available. In addition, several series of, for example, different colours are provided.

Since each pixel can be composed of a variable number of ink droplets, or at any rate of a variable number of a specific series (colour), only some of the number of ink droplets allocated to a pixel can be sent to the substrate. For that purpose, the ink droplets not required are intercepted. Only part of each series of ink droplets therefore generally reaches the substrate.

In a method of the type mentioned in the preamble, the problem occurs that the ink droplets influence each other on their way to the substrate. Not only can air whirls influence the paths of the ink droplets, but electric charges of the ink droplets can also repel each other. This means that it is possible that the ink droplets may not reach the envisaged place on the substrate, with the result that the pixels are not formed well and the image quality is adversely affected.

Although electrically charged ink droplets with the same polarity repel each other, ink droplets which, in spite of that, go very close to each other coalesce, with the result that the correct image structure may likewise be distorted.

In order to solve these problems, it was proposed earlier that each set of pixels (situated on different image lines) be formed not in succession, but staggered (interlacing). That reduces the coalescence of ink droplets, but the ink droplets still influence each other.

An alternative form of interlacing is described in Japanese Patent Application JP 03-055259. In that application successive pixels are divided alternately into a first and a second group, which groups are printed in different cycles. This means that several printing cycles are always necessary, so that the necessary printing time increases.

It has also been proposed that every other droplet from each series of ink droplets be intercepted. Although this may greatly reduce the extent to which the droplets influence each other, the output of the ink-jet printer is halved.

European Patent Application EP 0 036 788 discloses an ink-jet printer for essentially simultaneously printing several image lines in a grid, in which twenty-four of every fifty-six ink droplets are intercepted in accordance with a predetermined pattern. The output of this known ink-jet printer is thus at most approximately 57%. In addition, only a single ink droplet is allocated to each pixel, which greatly restricts the printing possibilities and the printing quality to be achieved.

SUMMARY OF THE INVENTION

The object of the invention is to eliminate the abovementioned disadvantages of the prior art and to provide a method for forming pixels on a substrate which allows the ink droplets to influence each other as little as possible, while giving the greatest possible output. To this end, a method of the type mentioned in the preamble is characterized in that the ink droplets which are sent to a pixel are distributed essentially homogeneously over the series.

The extent to which the ink droplets influence each other is minimized by distributing the ink droplets sent to a pixel on the substrate homogeneously over the series as far as possible. Owing to the fact that the predetermined intercepting of, for example, every other ink droplet is no longer necessary in most cases, the output of the ink-jet printer is considerably improved. While in the ink-jet printer according to the prior art a predetermined number of ink droplets is always intercepted, irrespective of the image to be printed, in an ink-jet printer according to the invention in principle ink droplets are intercepted only in order to achieve a certain grey tone.

The invention further provides an ink-jet printer in which the abovementioned method is applied.

BRIEF DESCRIPTION OF THE DRAWINGS

The invention will be explained in greater detail below with reference to the drawing.

FIG. 3 shows an example of the allocation of a series of ink droplets according to the prior art.

FIG. 4 shows an example of the allocation of a series of ink droplets according to the invention.

FIG. 5 shows a table with the allocation of ink droplets according to the invention.

DESCRIPTION OF THE PREFERRED EMBODIMENTS

A group of ink droplets can consist of only one ink droplet, in which case an essentially uniform distribution of ink droplets over the series is achieved. A group of ink droplets can also consist of at least two ink droplets, in which case the groups are, but the individual ink droplets are not, homogeneously distributed over the series. However, since a group of ink droplets is always sent to a single pixel, droplets intended for different pixels (which are situated on different lines) are actually prevented from influencing each other.

The grouping of ink droplets intended for the same pixel has the advantage that any coalescence which may occur in this group of ink droplets reduces the spread of these ink droplets, with the result that there is a greater chance of these droplets reaching the correct position on the substrate. This means that, for example, fluctuations in the times at which the ink droplets are formed and/or charged will be evened out.

The groups of ink droplets can be allocated sequentially to the pixels, so that the pixels of the set of lines are formed in succession. Little of the undesired phenomenon of droplets influencing each other will occur, owing to the homogeneous distribution of the ink droplets over the series according to the invention. The groups of ink droplets are advantageously allocated in a staggered manner to the pixels. The undesired phenomenon of droplets influencing each other is further reduced by also using interlacing.

Figure 1:
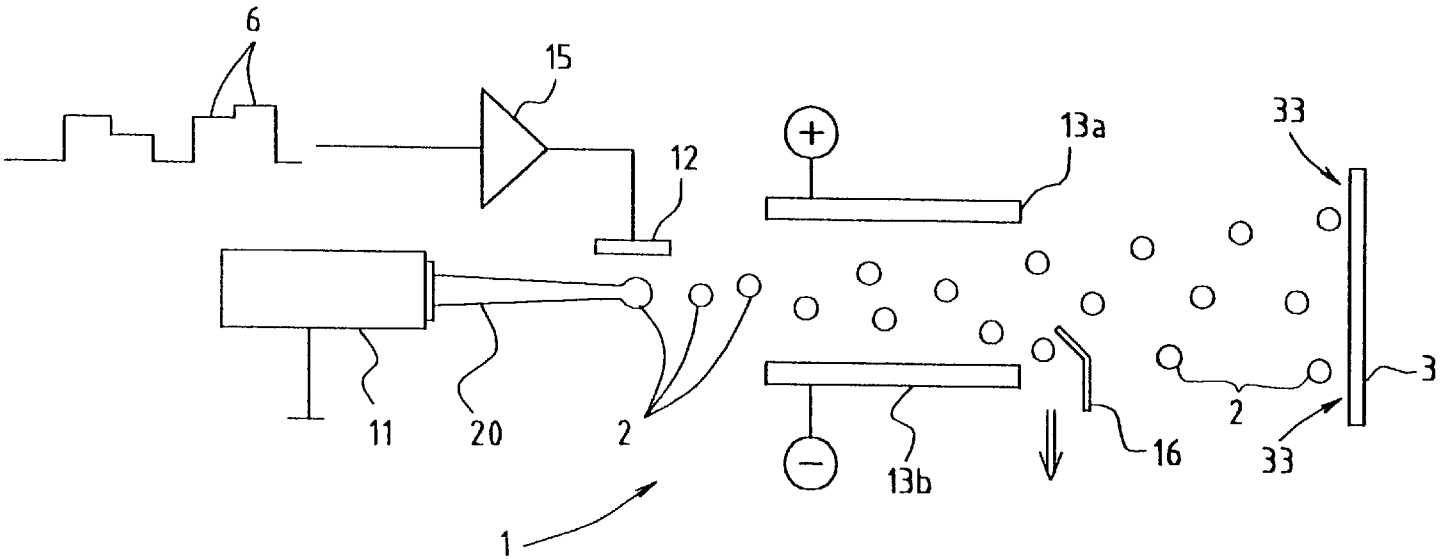
FIG. 1 shows diagrammatically an ink-jet printer in which the method according to the invention can be used.

The ink-jet printer 1 shown diagrammatically in FIG. 1 comprises an ink nozzle 11, which produces an ink jet 20 directed at the substrate 3. At the level of the charging electrode 12, the ink jet 20 breaks up into individual ink droplets 2. The rhythm of breaking up, and consequently the number of ink droplets 2 produced per second, can be influenced by fitting a vibrating element (not shown) on the ink nozzle 11. Charging pulses 6 are supplied to the charging electrode 12 by way of an amplifier 15. A potential difference in relation to the ink jet 20 is thereby produced on the charging electrode 12, which is electrically connected to earth by way of the ink nozzle 11. The ink droplets 2 forming in each case will consequently be electrically charged under the influence of the charging pulses 6. Presenting the charging pulses 6 to the amplifier 15 in the rhythm at which the ink droplets 2 are formed at the end of the ink jet 20 ensures that each ink droplet 2 can be given an individual charge.

A direct voltage is supplied to the deflecting electrodes 13, as a result of which an electric field prevails between these electrodes. Under the influence of the electric field, the ink droplets 2 are deflected to a greater or lesser extent, depending on their charge. In the case shown, charging pulses 6 with four different voltage levels are applied, V0, V1, V2 and V3 respectively. Under the influence of a charging pulse with voltage V0, which can be equal to 0 volt, the ink droplets 2 are deflected to the intercepting element ("knife") 16. These intercepted ink droplets do not reach the substrate, but are discharged for possible reuse. Charging pulses with a voltage V1, V2 or V3 make the ink droplets move to three different positions on the substrate, as shown in FIG. 1. In this way, three different pixels can be formed essentially simultaneously.

Of course, it is possible to generate charging pulses with only two different voltage levels (V0 and V1), as a result of which the ink droplets are either guided to a (fixed) position on the substrate or are intercepted. It is also possible to use (many) more than three voltage levels.

Figure 2:
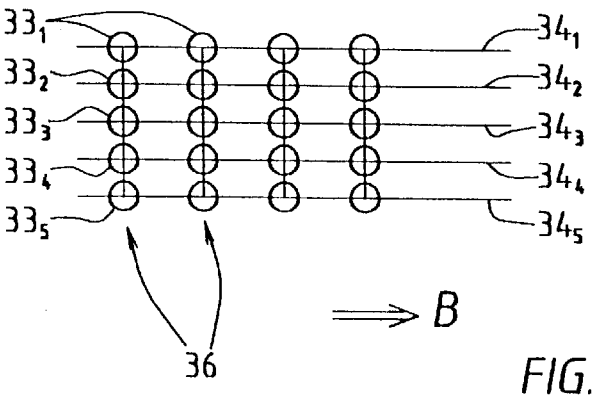
FIG. 2 shows diagrammatically a set of image lines, each with a number of pixels.

FIG. 2 shows diagrammatically a number of image lines 34, which are made up of pixels 33. In the example shown, five pixels $\mathbf{33}_1$–$\mathbf{33}_5$, which are situated on the image lines $\mathbf{34}_1$–$\mathbf{34}_5$ respectively, are always formed essentially simultaneously. This is achieved by distributing a series of ink droplets over the (in this case five) pixels of a set 36, for example by means of the charging and deflecting elements described with reference to FIG. 1.

During the printing, a print head provided with one or more ink nozzles moves in the direction indicated by B relative to the substrate 3. In this way, a set of pixels 33 can always be printed essentially simultaneously. It will be clear that the invention is not limited to the simultaneous printing of five image lines, but that two, three, four or more than five image lines can just as easily be printed simultaneously. The invention can also be used for printing only one image line.

Furthermore, the sequence in which the pixels of the different lines are formed can be varied. It is possible to allocate successive ink droplets to successive pixels, so that an ink droplet is always applied to a pixel, after which the next ink droplet is applied to the next pixel. The pixels in question are passed through sequentially in a number of cycles here, until the maximum number of ink droplets per pixel (for example, 15) has been reached. It is also possible to apply interlacing, as a result of which the five image lines shown are, for example, passed through in the sequence 1-3-5-2-4 instead of 1-2-3-4-5. Other interlacing sequences are also possible, such as those in which several successive droplets (i.e. a group of droplets) are sent to the same pixel, for example 1-1-3-5-5-5-2-2-4-4.

The method according to the invention will be explained in greater detail by means of reference to an example. We assume five image lines 34 with a set of pixels 33. The number of ink droplets per pixel, the so-called "word value" depends on the image to be printed, and in this example is selected as follows:

line 1: WV=1
line 2: WV=7
line 3: WV=3
line 4: WV=6
line 5: WV=6

The lines 1 to 5 correspond here to the pixels $\mathbf{34}_1$–$\mathbf{34}_5$ of FIG. 2.

Since the maximum word value in this example is 15 (a maximum of fifteen ink droplets per pixel), a series of 5×15=75 ink droplets is available for each set of five pixels. Each ink droplet sent to a pixel 33 is provided with a charging voltage (see FIG. 1). The charging voltages necessary for sending ink droplets to one of the image lines 1–5 will be indicated below as V1–V5. The charging voltage at which ink droplets are intercepted is indicated by a charging voltage 0. This charging voltage need not be equal to 0 in practice.

The table of FIG. 3 shows how the pixels of the above example would be formed from a series of seventy-five ink droplets according to the prior art. The first-droplet is sent with a charging voltage V1 to image line $\mathbf{34}_1$. The second droplet is sent with a charging voltage V3 to image line 343, according to the interlacing sequence 1-3-5-2-4. After the first five droplets, all pixels $\mathbf{33}_1$–$\mathbf{33}_5$ are provided with an ink droplet. Since the pixel 33, has to be printed with a word value 1, droplet No. 6 must be intercepted. Droplet No. 7 is sent, again with a charging voltage V3, to image line $\mathbf{34}_3$.

This process is continued up to and including droplet 34, which is sent to pixel $\mathbf{33}_2$. All further droplets are intercepted (charging voltage 0). As can be seen clearly from FIG. 3, many droplets are initially sent one after the other to the substrate and (in the example shown) from droplet 35 onwards all further droplets of the series are intercepted. So at the beginning of the series several ink droplets are sent one after the other to different image lines. This leads to a great chance of the ink droplets influencing each other, and thus a great chance of distortion of the image to be formed. It will be clear that this is undesirable.

FIG. 4 shows the way in which the ink droplets of the series of the same example are sent to the substrate according to the invention. In this example the first four ink droplets are intercepted, the fifth ink droplet is sent to pixels $33_4$, three ink droplets are then intercepted, after which the ninth ink droplet is sent to a pixel, and so on. With this essentially homogeneous distribution over the series of ink droplets sent to the substrate, it is virtually impossible for the ink droplets to influence each other. Yet no more ink droplets than necessary are intercepted.

It is pointed out that in the above example, only one ink droplet in each case is sent to a pixel. It is also possible to send a group of successive ink droplets to the same pixel. The way in which the ink droplets influence each other here can actually have a positive effect in that case. It will be clear that FIG. 4 can be adapted in a corresponding manner, in which case the series will comprise a multiple of the seventy-five ink droplets shown. If only one pixel is formed simultaneously, coalescence of a number of droplets (for example, two to four) can make up for fluctuations in the times of the charging pulses.

FIG. 5 shows by way of example for a number of word values the allocation of the ink droplets according to the invention. In this case FIG. 4 is made up of the data from FIG. 5. Each diagram of FIG. 5 shows the distribution of the droplets over the series for a different word value (number of droplets per pixel). In each diagram the image lines are always given on the left and the cycles at the top. Each cycle corresponds to passing through all image lines once. In the case of a word value equal to 1 ("WV 1") all droplets are intercepted in the first two cycles (times that the set of pixels are passed through).

In the third cycle an ink droplet (No. 13) is sent to pixel 5. No pixel is then formed in cycles 4, 5 and 6, while in cycle 7 an ink droplet (No. 32) is sent to the third image line. The single ink droplet for the first image line is sent in cycle 11, and those for image lines 4 and 2 in cycles 14 and 15 respectively. In this way, the ink droplets for this word value are distributed essentially homogeneously over the series of seventy-five ink droplets.

The next diagram shows the distribution of the ink droplets over the series for a word value equal to 2 ("WV 2"). According to a further aspect of the invention, the diagrams are additive, in other words, the diagram for word value 2 is obtained by adding values to the diagram for word value 1. The values of the diagram of word value 1 are therefore present in all subsequent diagrams. However, it is not essential for the diagrams to be additive.

As can be seen from the diagram for word value 2, the ink droplets for the first image line are sent to the substrate in cycles 8 and 11 (droplets Nos. 36 and 51 respectively). It will be clear that here again a homogeneous distribution has been achieved.

At higher word values, for example a word value equal to 12, a number of successive droplets will have to be sent to different lines on the substrate. Distributing the ink droplets to be intercepted as homogeneously as possible over the series ensures that ink droplets actually influence each other to the least possible extent. Besides, it has been found that the adverse effects of ink droplets influencing each other are less great at higher word values, so that a lower spread of the ink droplets will suffice.

Although ink has been always spoken of above, another substance, such as a dye, can also be used instead of ink. The effect according to the invention can also be obtained by allocation diagrams other than those shown in FIG. 5. It will therefore be clear to persons skilled in the art that many modifications and additions are possible without going beyond the scope of the invention.

What is claimed is:

1. Method for printing essentially simultaneously a set of pixels lying on different image lines on a substrate from a single series of ink droplets using an ink jet printer having at least one ink jet nozzle, the method comprising the steps of:

allocating a group of ink droplets from the single series to each of the pixels to be printed essentially simultaneously, and depositing ink droplets from the groups of ink droplets in the pixels concerned or intercepting the ink droplets, depending on the number of ink droplets required for a pixel, wherein at least one of the pixels from the set of pixels is printed by more than one ink droplet from the single series, wherein the ink droplets of each group which are sent to a pixel are distributed essentially homogeneously over the single series, and wherein the ink droplets of different groups are also distributed essentially homogenously over the single series.

2. Method according to claim 1, wherein the ink droplets of each group which are sent to a pixel are individually distributed over the single series.

3. Method according to claim 1, wherein the ink droplets are allocated sequentially to the pixels.

4. Method according to claim 1, wherein the ink droplets are allocated in a staggered manner to the pixels.

5. Method according to claim 1, wherein the ink droplets from the single series, which have to be intercepted in the case of a specific number of ink droplets required for a pixel, are predetermined.

6. Method according to claim 5, wherein the ink droplets which are not to be intercepted are distributed essentially homogeneously over the series.

7. Method according to claim 1, wherein the number of essentially simultaneously formed pixels is between 2 and 10.

8. Method according to claim 1, wherein the number of essentially simultaneously formed pixels is 5.

* * * * *